US008485462B2

(12) United States Patent
Nakamaki et al.

(10) Patent No.: US 8,485,462 B2
(45) Date of Patent: Jul. 16, 2013

(54) METHOD OF CONTROLLING PAPER TRANSPORTATION IN AN APPARATUS, AND AN APPARATUS USING THE METHOD

(75) Inventors: Motohiro Nakamaki, Azumino (JP); Ichimi Masuda, Shiojiri (JP); Nobuhiro Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 848 days.

(21) Appl. No.: 12/384,851

(22) Filed: Apr. 8, 2009

(65) Prior Publication Data

US 2009/0255971 A1 Oct. 15, 2009

(30) Foreign Application Priority Data

Apr. 10, 2008 (JP) ..... 2008-102196
Mar. 2, 2009 (JP) ..... 2009-047652

(51) Int. Cl.
*B65H 51/30* (2006.01)

(52) U.S. Cl.
USPC ..... 242/418.1

(58) Field of Classification Search
USPC ..... 242/413.1–413.4, 417.1–417.3, 418.1, 242/419–419.3, 420, 420.5, 420.6
See application file for complete search history.

(56) References Cited

U.S. PATENT DOCUMENTS 3,704,820 A * 12/1972 Frederick et al. ..... 242/418.1
4,789,813 A * 12/1988 Orchard ..... 242/420.5
5,362,008 A * 11/1994 Nagel et al. ..... 242/418.1
5,825,374 A * 10/1998 Albertalli et al. ..... 242/417.3
6,474,883 B1 * 11/2002 Kawakami et al. ..... 400/613
6,641,314 B2 * 11/2003 Mogi ..... 400/120.01
6,824,032 B2 * 11/2004 Kumatori ..... 242/418.1
7,422,385 B2 * 9/2008 Koeda et al. ..... 400/618
7,563,045 B2 * 7/2009 Nagata ..... 400/693
7,878,724 B2 * 2/2011 Yamagata ..... 400/664
7,984,871 B2 * 7/2011 Nagata ..... 242/413.3

FOREIGN PATENT DOCUMENTS

EP 1 721 851 A2 11/2006
EP 1 780 029 A1 5/2007
JP 1-141050 9/1989
JP 2004-107021 A 4/2004
JP 2004-217364 A 8/2004
JP 2006-218711 8/2006
JP 2007-203563 8/2007
JP 2007-203564 8/2007
WO WO 2006/069164 A2 6/2006

OTHER PUBLICATIONS

European Search Report issued on Sep. 9, 2009 in EP09004910.7, which corresponds to U.S. Appl. No. 12/384,851.

* cited by examiner

*Primary Examiner* — William A Rivera
(74) *Attorney, Agent, or Firm* — Nutter McClennen & Fish LLP; Johnny J. Penny, Jr.; Christina M. Sperry

(57) ABSTRACT

A paper transportation control method for an apparatus enables conveying paper with appropriate tension on the paper by appropriately controlling a paper delivery operation of a delivery roller. When paper is conveyed by a paper feed roller pair of a roll paper printer, and tension on the paper is detected to exceed an upper tension limit based on displacement of a damping mechanism (a first time), a paper delivery operation of a delivery roller pair starts at a second time after a start operation delay time corresponding to a feed rate passes after the first time. When the tension returns to or below the upper tension limit, the paper delivery operation stops at a third time after a stop operation delay time similarly corresponding to the feed rate passes.

16 Claims, 11 Drawing Sheets

| CORRELATION TABLE A | | |
|---|---|---|
| FEED RATE V(34) | | START DELAY TIME DLS (FIRST DELAY TIME) |
| S1 | SLOW | T1 LONG |
| S2 | | T2 |
| S3 | | T3 |
| S4 | FAST | T4 SHORT |
FIG. 5B
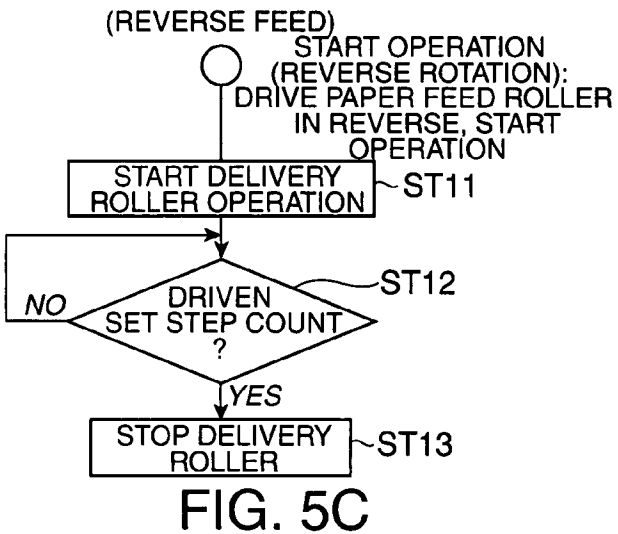
FIG. 5C
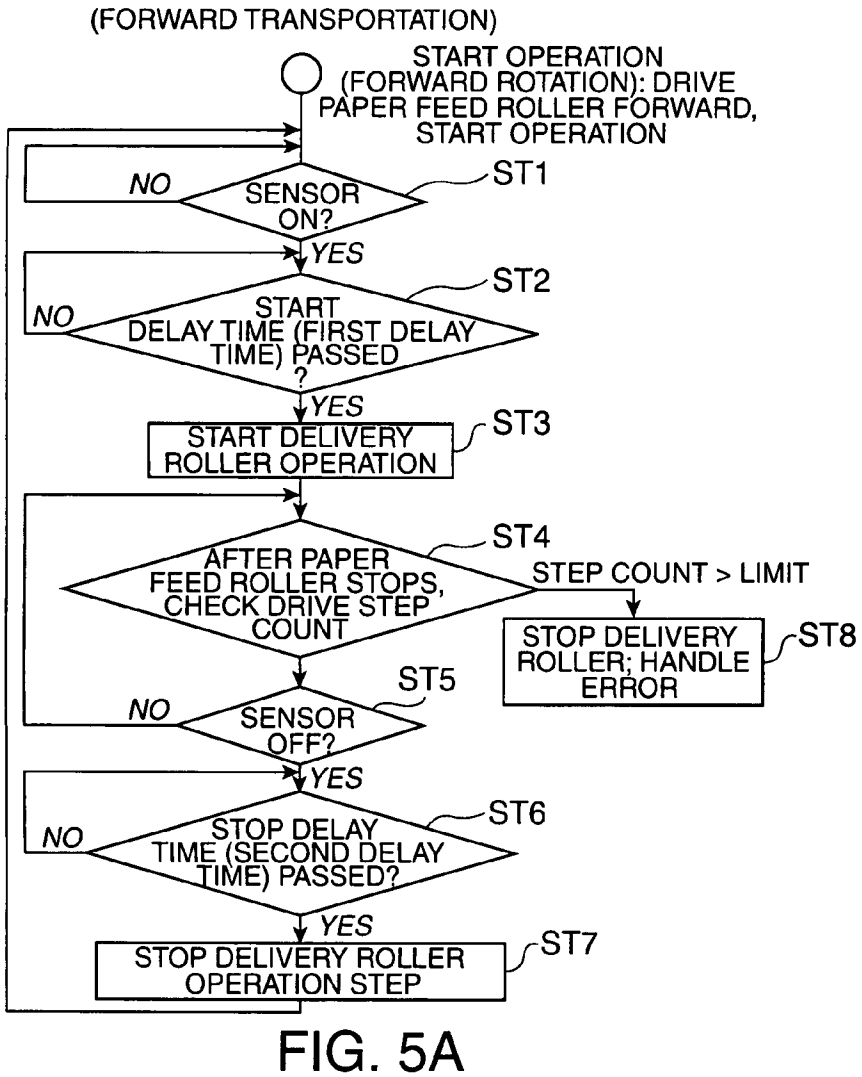
FIG. 5A

METHOD OF CONTROLLING PAPER TRANSPORTATION IN AN APPARATUS, AND AN APPARATUS USING THE METHOD

This application claims priority under 35 U.S.C. §119 to Japanese Patent Application Nos: 2008-102196 filed on Apr. 10, 2008, and 2009-047652 filed on Mar. 2, 2009, the entire disclosure of which are expressly incorporated by reference herein.

BACKGROUND OF THE INVENTION

1. Technical Field

The present invention relates to an apparatus that drives a delivery roller and a paper feed roller to convey a continuous paper web pulled off a paper roll, for example, to a printing position for printing while adjusting the paper tension by a tension damping mechanism. The invention also relates to a paper transportation control method for an apparatus that can control the paper supply operation of the delivery roller that assists the paper feed operation of the paper feed roller.

2. Description of Related Art

Roll paper, which is a continuous web of paper wound into a roll, is used in roll paper printers for printing receipts, for example. The roll paper is stored freely rotatably in a roll paper compartment, and a paper feed roller conveys the paper pulled off the paper roll to a printing position for printing by a print head at the printing position. If the paper transportation load varies greatly at this time, the paper may not be conveyed at a uniform rate or the paper may become skewed during paper transportation by the paper feed roller, and such transportation problems can result in a drop in print quality. As a result, the part of the paper between the paper roll and the paper feed roller may therefore be routed around a tension damping mechanism that is urged by an urging member to maintain a specific tension on the paper while absorbing (damping) variation in the transportation load by displacement of the damping mechanism.

The transportation load on the paper feed roller increases as the size of the paper roll increases. The inertia of the paper roll results in a significant difference in the transportation load between when transportation starts, during transportation, and when paper transportation stops. There is also a significant difference in the paper transportation load between when a new roll is loaded and used for the first time, and when the roll is nearly depleted and the roll diameter is close to the size of the core. The paper transportation roller alone can therefore not sufficiently suppress deviation in the uniformity of paper transportation, and some printers therefore also have a delivery roller to assist paper transportation by pulling the paper off the paper roll. Japanese Unexamined Patent Appl. Pub. JP-A-2007-203563 and Japanese Unexamined Patent Appl. Pub. JP-A-2007-203564 teach a roll paper supply mechanism with this type of delivery roller.

Driving the delivery roller can be controlled using sensors to monitor the paper tension. The sensor can simply detect the position of the tension damping mechanism, which is displaced by the paper tension. If the tension exceeds an upper tension limit, the paper delivery operation of the delivery roller starts to assist paper transportation by the paper transportation roller, and the delivery operation stops when the paper tension returns to or below the upper tension limit.

Serial printers with a carriage operate by printing one line while paper transportation is stopped and then advancing the paper one line before stopping again and printing the next line, and the paper tension (paper transportation load, also referred as paper feed load) is therefore constantly changing as a result of thus intermittently conveying the paper.

SUMMARY OF THE INVENTION

A printer and a method of controlling paper transportation in a printer according to at least one embodiment of the present invention enable conveying paper with a desirable amount of tension constantly applied to the paper by suitably controlling the paper delivery operation of a delivery roller.

A first aspect of the invention is a paper transportation control method for an apparatus having a delivery roller that delivers paper and a paper feed roller that feeds the paper delivered, and a damping mechanism located between the delivery roller and the paper feed roller and for adjusting a tension on the paper, the paper transportation control method including steps of detecting if the tension on the paper exceeds a predefined upper tension limit, and starting the paper delivery operation of the delivery roller when the paper is conveyed forward after elapse a first delay time from when the tension is detected to exceed the upper tension limit.

When the paper is conveyed forward, this aspect of the invention stops the paper delivery operation of the delivery roller after elapse a second delay time from when the tension is detected to become less than or equal to the upper tension limit.

When feeding the paper while printing, the paper tension (feed load) changes constantly. Even if the paper tension momentarily exceeds the upper tension limit, it often soon returns below the upper tension limit. If the delivery operation of the delivery roller is controlled to start and stop immediately according to the output of the sensor that detects the paper tension, the delivery operation will start and stop frequently particularly if the tension on the paper is near the upper tension limit. The tension will therefore fluctuate repeatedly above and below the upper tension limit, leading to a so-called chattering or fluttering condition. At least one embodiment of the invention therefore imparts hysteresis of a specific time to controlling the paper delivery operation so that the delivery operation does not start and stop frequently. This chattering or fluttering problem is thus avoided.

In the paper transportation control method of an apparatus according to another aspect of the invention the delay time of at least one of the first delay time (start operation delay time) and second delay time (stop operation delay time) becomes shorter as the paper feed rate of the paper feed roller becomes faster.

When the paper feed rate is fast, the tension on the paper increases in a short time. A correspondingly short time is therefore preferably set as the first delay time so that the delivery roller can quickly adjust the paper feed operation. A short time is also preferably set as the second delay time to quickly stop the paper delivery operation of the delivery roller when the tension on the paper returns to or below the upper tension limit in order to prevent the paper tension from dropping greatly, resulting in excessive paper slack that can easily result in a paper jam.

In the paper transportation control method of an apparatus according to another aspect of the invention the delivery speed of paper by the delivery roller is faster than the feed rate of the paper feed roller when the paper is conveyed forward.

By setting the delivery speed of the delivery roller so that it is always faster than the feed rate of the paper feed roller, the paper tension can be reduced and the feed load on the paper feed roller can be reduced, and the paper can be advanced with good precision to the printing position downstream from the paper feed roller.

In the paper transportation control method of an apparatus according to another aspect of the invention, when the paper is conveyed forward, the length of paper delivered by the delivery roller is counted from when the paper feed operation of the paper feed roller stops, and the delivery operation of the delivery roller is stopped when the delivered length of paper exceeds a predefined amount.

If the delivery operation of the delivery roller continues after the paper feed operation of the paper feed roller stops, the portion of paper located between these rollers can lead to a paper jam. This can be treated as an apparatus error, such as a problem with the paper or the sensor that detects tension, and operation is therefore preferably stopped immediately.

In the paper transportation control method of an apparatus according to another aspect of the invention the paper return operation is executed by the delivery roller only when the reverse feed length of the paper by the paper feed roller is greater than or equal to a first amount when conveying the paper in reverse.

In general, if the reverse feed length of the paper is short, the amount of paper reversed to between the delivery roller and paper feed roller is minimal if any even if the paper return operation of the delivery roller is not executed, and there is no danger of a paper jam. Driving the delivery roller can be omitted.

However, if the reverse feed length is great, a large amount of paper will be reversed to between the delivery roller and paper feed roller and become crumpled between the rollers if the paper return operation of the delivery roller is not executed. When paper becomes crumpled between the rollers, the crumpled paper can easily cause a paper jam the next time the paper is fed forward.

At least one embodiment of the invention pulls the portion of paper that was reversed by the paper feed roller back by the delivery roller when the length of paper fed in reverse is greater than or equal to a first amount. Therefore, the portion of paper that was fed in reverse is not crumpled when the length of the paper is long, and paper jams can be prevented.

Further preferably, starting the paper return operation of the delivery roller is linked to starting the reverse feed operation of paper by the paper feed roller.

When the paper is fed in reverse, there is not a large load from the inertia of the paper roll or variation in the load, the paper can generally be fed at a constant rate, and there is little change in the paper transportation load. Therefore, starting the paper return operation of the delivery roller can be linked to starting the reverse feed operation of paper by the paper feed roller.

When conveying the paper in reverse, the return speed of paper by the delivery roller is set slower than the reverse feed rate of paper by the paper feed roller, that is, opposite the relationship when the paper is fed forward, to prevent excessive tension on the paper between the paper feed roller and delivery roller.

In addition, when conveying the paper in reverse, the return length of paper by the delivery roller is set to a value less than the reverse feed length of paper by the paper feed roller, and the delivery roller is stopped when the delivery roller pulls the paper back the return length.

In general, because there is some tolerance for paper slack on the transportation path between the paper feed roller and delivery roller, the length of paper returned by the delivery roller can be less than the reverse feed length.

In a paper transportation control method for an apparatus according to another aspect of the invention when conveying the paper in reverse, the return speed of paper by the delivery roller and the reverse feed rate of paper by the paper feed roller are set substantially the same, and the reverse feed operation of paper by the paper feed roller and the return operation of paper by the delivery roller are executed synchronously.

When conveying the paper forward stops in this aspect of the invention, the tension on the paper is less than the upper tension limit, and the paper is held in a suitably tensioned state. Therefore, if the return speed of paper by the delivery roller and the reverse feed rate of paper by the paper feed roller are set substantially the same, and the reverse feed operation of paper by the paper feed roller and the return operation of paper by the delivery roller are executed synchronously, the paper can be reversed with the paper held with the same appropriate tension that was applied to the paper when forward transportation stopped between the paper feed roller and delivery roller. As a result, because the paper can be prevented from becoming skewed between the paper feed roller and delivery roller while the paper is conveyed in reverse, the amount of paper fed in reverse by the paper feed roller is stable and the position of the paper does not shift widthwise. Therefore, a drop in print quality can be avoided when the paper is next fed forward for printing. Furthermore, because the paper loosens on the upstream side of the delivery roller when the paper is thus conveyed in reverse, when the paper is next fed forward for printing the inertia of the paper roll takes effect when the slack is taken up, and there is a sudden increase in the load on the paper feed roller. However, because the tension on the paper is held to less than the upper tension limit while the paper is reversed, any such load that occurs is within the range that can be buffered by the damping mechanism.

In a paper transportation control method for an apparatus according to another aspect of the invention, when conveying the paper in reverse, the return length of paper by the delivery roller is set greater than or equal to a predefined second amount and greater than or equal to the reverse feed length of the paper by the paper feed roller, and the return speed of paper by the delivery roller is set slower than the reverse feed rate of the paper by the paper feed roller. The paper return operation of the delivery roller starts, the reverse feed operation of paper by the paper feed roller starts when the length of paper returned by the delivery roller reaches the second amount, and the return operation of the delivery roller stops when the delivery roller has pulled the paper back the return length.

In this aspect of the invention, when forward transportation of the paper stops, the paper is held suitably tensioned with the tension on the paper less than the upper tension limit. When the paper is then conveyed in reverse, the return operation of the delivery roller starts first to pull the paper back the second amount and increase the tension on the paper. The reverse feed operation of the paper feed roller then starts at a faster reverse feed rate than the return speed at which the delivery roller pulls the paper back. The paper can therefore be reversed while the tension on the paper drops from the high tension level.

Furthermore, because the length the paper is pulled back by the delivery roller is greater than or equal to the length the paper feed roller conveys the paper in reverse, the paper can be held with a specific tension on the paper between the paper feed position and the position the paper is pulled off the roll. Because the paper can thus be prevented from becoming skewed between the paper feed position and the delivery position while the paper is reversed, the amount of paper fed in reverse by the paper feed roller is stable and the position of the paper does not shift widthwise. Therefore, a drop in print quality can be avoided when the paper is next fed forward for printing. Furthermore, the paper loosens on the upstream side of the delivery roller when the paper is thus conveyed in reverse. When the paper is next fed forward for printing and the slack is taken up, there is a sudden increase in the load on the paper feed roller. However, because the tension on the paper is held to less than the upper tension limit while the paper is reversed, any such load that occurs is within the range that can be buffered by the damping mechanism.

Preferably, the second amount is equal to the return length that produces tension equal to the upper tension limit on the paper as a result of the paper return operation of the delivery roller.

When the delivery roller pulls the paper back the second amount, this aspect of the invention prevents the tension on the paper from exceeding the upper tension limit. Furthermore, because the second amount can be set long, the paper can be easily conveyed with specific tension on the paper even if the length of paper reversed by the paper feed roller is long.

In another aspect of the invention when the reverse feed length of paper by the paper feed roller is greater than or equal to the second amount, the return length of paper by the delivery roller is set substantially equal to the reverse feed length of paper by the paper feed roller.

With this aspect of the invention, when the reverse feed length the paper is conveyed in reverse by the paper feed roller is greater than or equal to the second amount, the tension on the paper when the operation conveying the paper in reverse stops and the tension on the paper when the operation conveying the paper in reverse starts are substantially the same. More specifically, when the operation conveying the paper in reverse stops, the paper returns to a suitably tensioned state. When the paper is then fed forward for printing, the tension on the paper can be easily held to a desirable level, and a drop in print quality can be avoided. Furthermore, because the tension on the paper will not exceed the predefined upper tension limit when the next forward feed operation starts, the paper feed roller operation will always start and high speed printing can be achieved without starting the paper delivery operation of the delivery roller after delaying the start until a specific second delay time has passed.

In general, the printer preferably forms paper slack between the pull-off position where the paper is pulled off the paper roll and the delivery roller. This reduces the load when forward transportation starts.

Another aspect of the invention is an apparatus that conveys a paper web by the paper transportation control method described above, the printer having a roll paper storage unit that stores roll paper; a delivery roller that delivers paper from the roll paper; a paper feed roller that feeds the delivered paper; a damping mechanism that adjusts the tension on the paper and is located between the delivery roller and the paper feed roller; a sensor that detects the tension on the paper; a paper feed motor that rotationally drives the paper feed roller; a delivery motor that rotationally drives the delivery roller; and a control unit that controls the paper feed motor and the delivery motor based on detection by the sensor, controls conveying the paper forward or reverse, and executes the paper transportation control method described in any of claims 1 to 13.

Another aspect of the invention is an apparatus that conveys a paper web by the paper transportation control method described above, and has a space formed between the roll paper storage unit and the delivery roller.

Effect of at Least One Embodiment of the Invention

At least one embodiment of the invention controls starting and stopping the paper delivery operation of a delivery roller after a specific delay time passes after the start and stop of the paper feed operation of a paper feed roller. The delay time is correlated to the feed rate of the paper feed roller, and the delay time becomes shorter as the paper feed rate becomes faster. Therefore, the tension on the conveyed paper can therefore be held at or below an upper tension limit and variation in the paper tension can be reduced without causing fluttering in the paper delivery operation of the delivery roller. The paper feed precision of paper fed to the printing position by the paper feed roller can therefore be increased, and print quality can be improved.

Furthermore, because the paper delivery operation of the delivery roller is controlled precisely according to the feed rate of the paper feed roller, variation in the paper tension can be suppressed, displacement of the damping mechanism that suppresses tension fluctuations can be reduced, a small damping mechanism can be used, and at least one embodiment of the invention is beneficial for reducing the print size and cost.

In addition, operation of the delivery roller can be stopped unconditionally if the paper delivery operation of the delivery roller continues even after the feed operation of the paper feed roller stops. This enables preventing problems related to a paper jam becoming more severe and the paper becoming damaged.

Furthermore, because the paper can be conveyed in tension between the paper feed position and the delivery position even when the paper is conveyed in reverse, the amount the paper is fed in reverse by the paper feed roller is stable and the position of the paper will not shift widthwise. The print quality will therefore not drop when the paper is next conveyed forward for printing. Furthermore, because the paper feed roller will always operate when the paper is conveyed forward, high speed printing can be achieved.

Other objects and attainments together with a fuller understanding of at least one embodiment of the invention will become apparent and appreciated by referring to the following description and claims taken in conjunction with the accompanying drawings.

BRIEF DESCRIPTION OF THE DRAWINGS

FIG. 5 is a flow chart of the delivery operation and the return operation.

DESCRIPTION OF PREFERRED EMBODIMENTS

A preferred embodiment of an apparatus employing the paper transportation control method of at least one embodiment of the present invention is described below with reference to the accompanying figures.

General Configuration

Figure 1A:
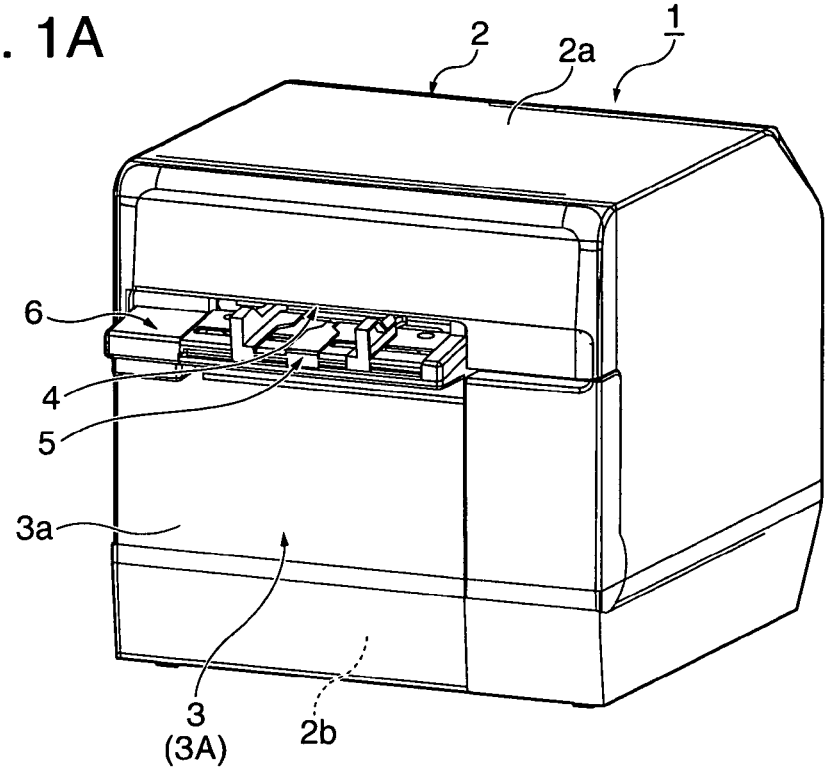
FIG. 1A and FIG. 1B are external oblique views of a printer according to a preferred embodiment of at least one embodiment of the invention.
Figure 1B:
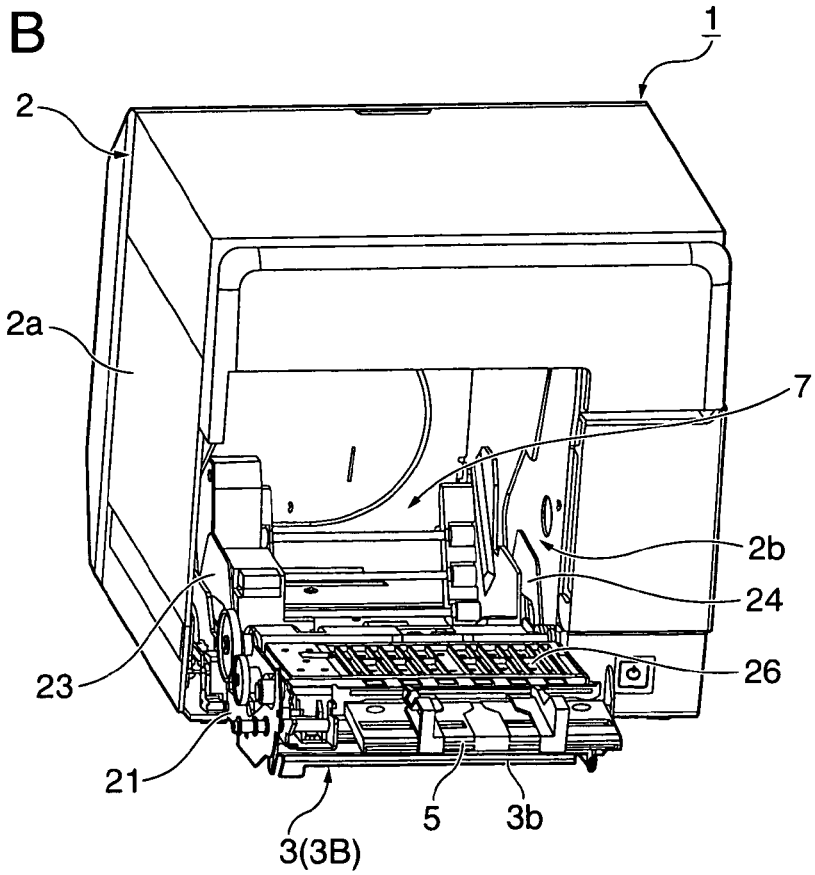

FIG. 1A is an oblique external view of a printer (an apparatus) that uses roll paper according to a preferred embodiment of the invention. FIG. 1B is an oblique view of the same printer with the cover open.

As shown in the figures, the roll paper printer 1 has a rectangular box-like case 2 and a cover unit 3 that opens and closes and is disposed to the front of the case 2. A paper exit 4 of a specific width is formed at the front of the outside case 2*a* part of the printer case 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover 3*a* of the cover unit 3.

Operating the cover opening lever 6 unlocks the cover unit 3. When the exit guide 5 is pulled forward, the cover unit 3 pivots at the bottom end part thereof and opens forward from the upright closed position 3A shown in FIG. 1A to a substantially horizontal open position 3B shown in FIG. 1B. When the cover unit 3 opens, the roll paper compartment 7 formed inside the printer is open. The platen 26 that defines the printing position also moves with the cover unit 3 at the same time, thus opening the paper transportation path from the roll paper compartment 7 to the paper exit 4 so that the roll paper can be easily replaced from the front of the printer. Note that the cover 3*a* of the cover unit 3 and the cover opening lever 6 are not shown in FIG. 1B.

Figure 2A:
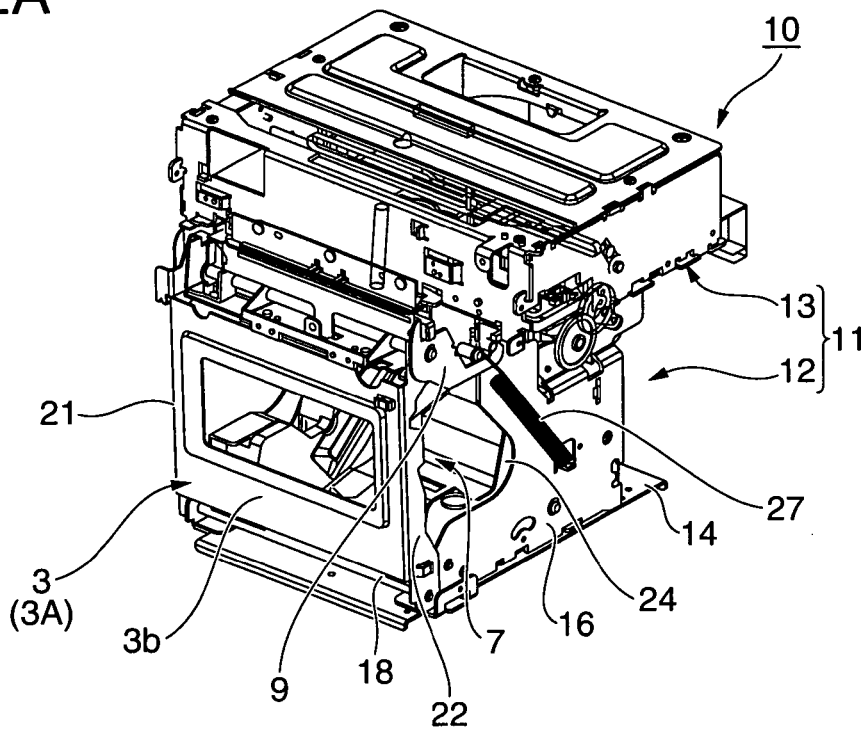
FIG. 2A and FIG. 2B are external oblique views of the printing mechanism unit of the printer.
Figure 2B:
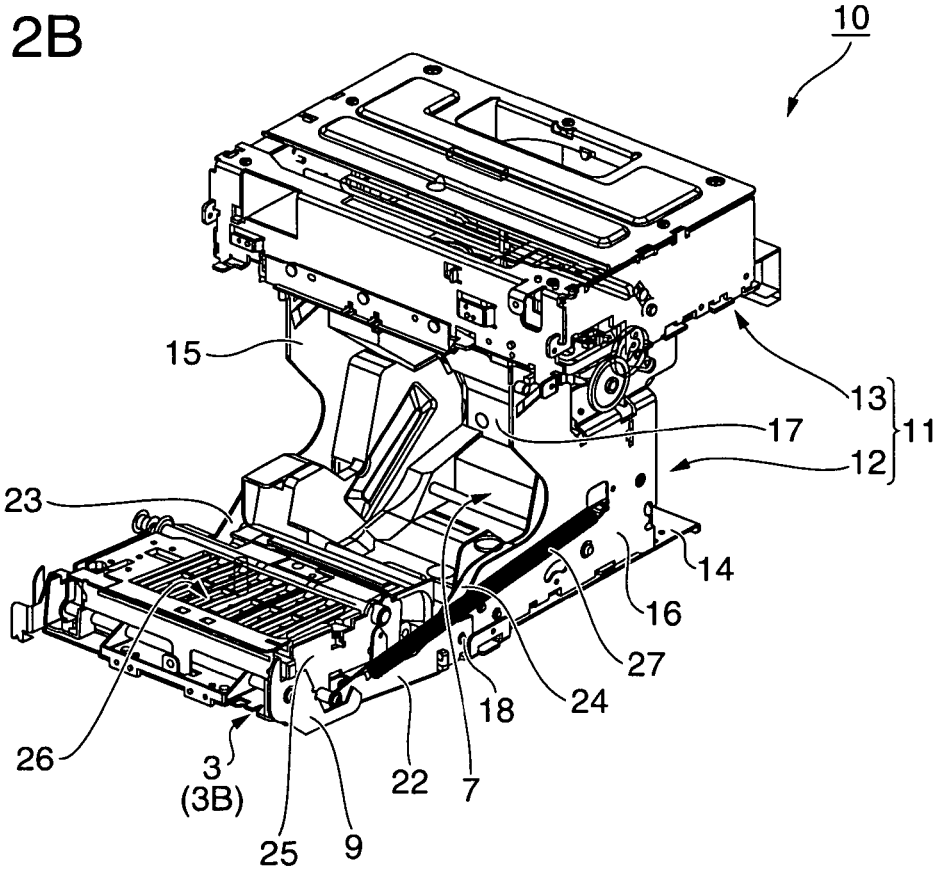

FIG. 2A and FIG. 2B are oblique views of the printing mechanism unit that is covered by the outside case 2*a* and cover 3*a* of the roll paper printer 1, FIG. 2A showing the printing mechanism unit when the cover unit 3 is closed and FIG. 2B showing the printing mechanism unit when the cover unit 3 is open.

The printer mechanism unit 10 has a printer frame 11 made of sheet metal to which other parts are disposed. Disposed to the printer frame 11 are a chassis-side frame unit 12 and a head-side frame unit 13 disposed horizontally to the top of the chassis-side frame unit 12.

The chassis-side frame unit 12 has a bottom 14, left and right side panels 15 and 16, and a back panel 17. The roll paper compartment 7 is rendered inside the chassis-side frame unit 12. A support shaft 18 travels horizontally widthwise to the printer at the front bottom ends of the left and right side panels 15 and 16, and the cover unit 3 is supported so that it can open and close around the support shaft 18.

The cover unit 3 has a rectangular cover frame 3*b* made of sheet metal, and this cover frame 3*b* is attached to a 4-part parallel linkage mechanism. This parallel linkage mechanism includes left and right front parallel links 21 and 22 and left and right rear parallel links 23 and 24. A rectangular box-like platen frame 25 is disposed horizontally between the tops of the four links 21 to 24. The platen 26 is attached horizontally to the top of the platen frame 25. This 4-part linkage mechanism enables the cover unit 3 to pivot between the closed position 3A shown in FIG. 2A and the open position 3B shown in FIG. 2B while holding the platen 26 substantially level.

A damper spring 27 rendered by a coil spring is attached between the cover unit 3 that opens and closes and the stationary side panel 16 of the printer frame 11. When the locking member 9 that holds the cover unit 3 in the closed position 3A is released so that the cover unit 3 can open, the damper spring 27 prevents the cover unit 3 from dropping forcefully forward and open.

Figure 3A:
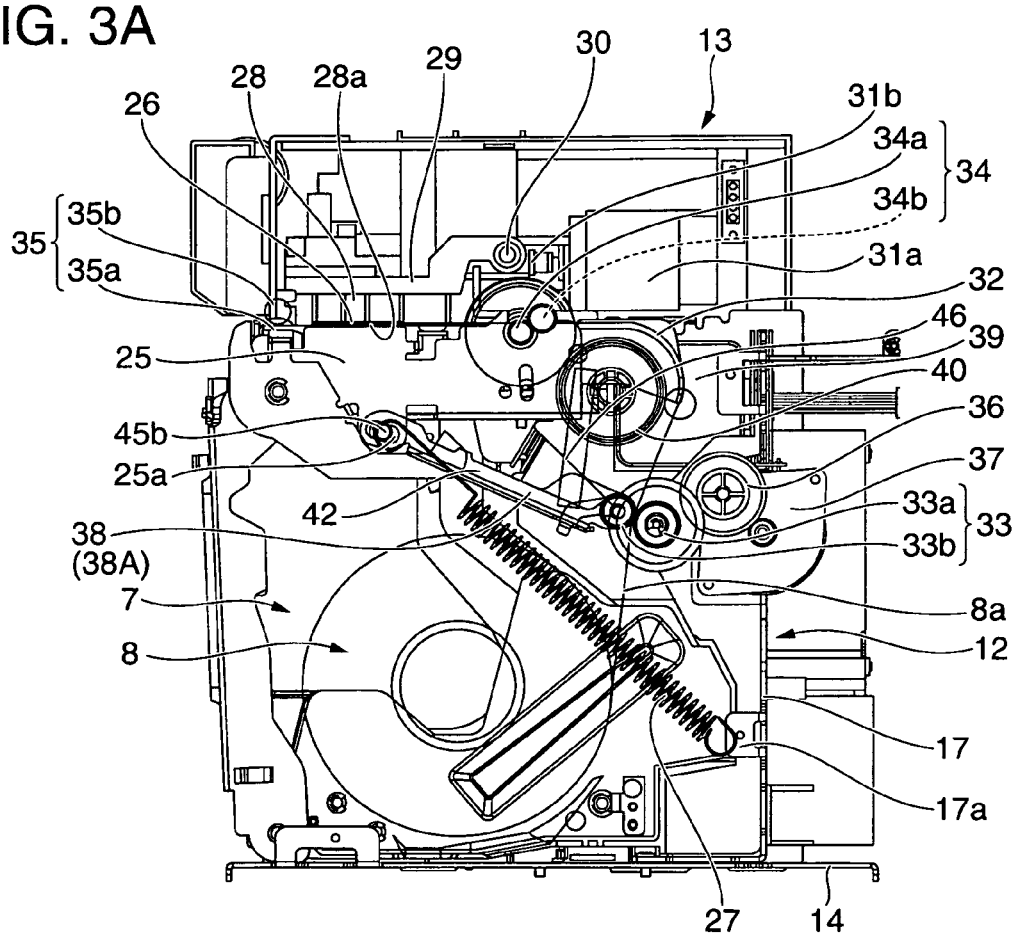
FIG. 3A is a schematic section view showing the inside of the printer.

As further described below, an inkjet head 28, a head carriage 29 on which the inkjet head 28 is carried, and a carriage drive mechanism are assembled inside the head-side frame unit 13 as shown in FIG. 3A.

Internal Configuration of the Printer

Figure 3B:
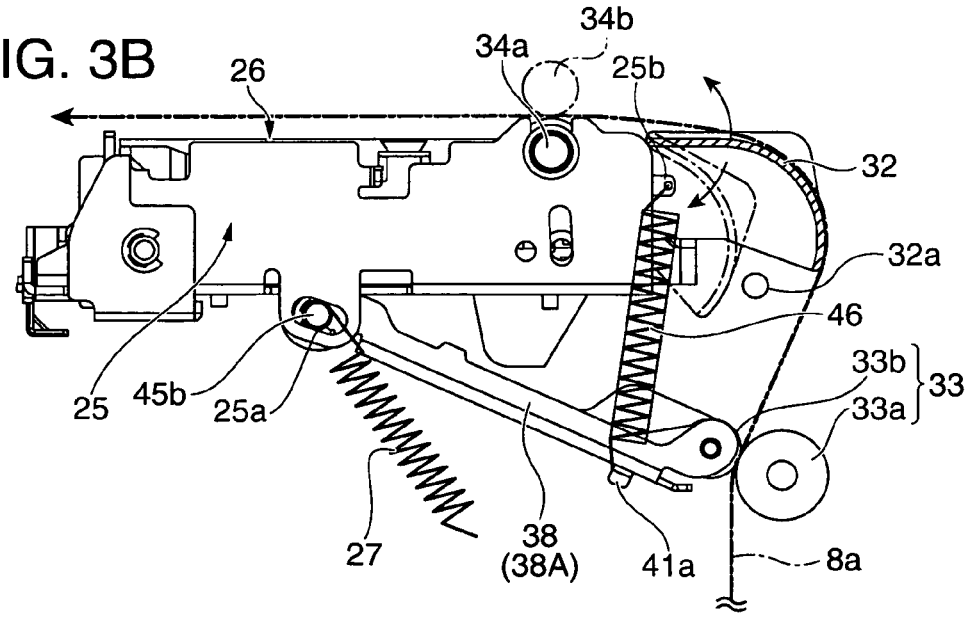
FIG. 3B is an enlarged view of a part of the inside.

FIG. 3A is a schematic section view showing the internal configuration of the roll paper printer 1, and FIG. 3B is section view of a part including the damping mechanism 32. As shown in the figures, the roll paper 8 is stored horizontally on its side widthwise to the printer in the roll paper compartment 7 formed inside the printer.

The head-side frame unit 13 is attached horizontally above the roll paper compartment 7. The inkjet head 28, the head carriage 29, and a carriage guide shaft 30 that guides movement of the head carriage 29 widthwise to the printer are disposed to the head-side frame unit 13. The inkjet head 28 is mounted on the head carriage 29 with the nozzle surface 28*a* facing down. A carriage transportation mechanism having a carriage motor 31*a* and a timing belt 31*b* for driving the head carriage 29 bidirectionally along the carriage guide shaft 30 is mounted on the head-side frame unit 13.

The platen 26 is disposed below the nozzle surface 28*a* of the inkjet head 28 with a constant gap therebetween, and the platen 26 determines the printing position of the inkjet head 28. A damping mechanism 32 that curves downward is disposed behind the platen 26 (on the upstream side of the paper transportation path).

As shown in FIG. 3B, the damping mechanism 32 can pivot vertically between the position indicated by the solid line and the position indicated by the imaginary line, and is constantly urged upward by a spring force. The paper 8*a* delivered from the roll paper 8 stored in the roll paper compartment 7 is pulled through the paper transportation path passed the printing position with a predetermined tension applied to the paper by the damping mechanism 32. A sensor 32*a* that detects when the damping mechanism 32 moves down a predetermined distance is disposed near the damping mechanism 32. The sensor 32*a* is a contact sensor such as a mechanical switch, but may be a contactless sensor such as a photosensor.

Disposed to the paper transportation path are a delivery roller pair 33 including a delivery roller 33*a* and a follower roller 33*b*, a paper feed roller pair 34 including a paper feed roller 34*a* and a follower roller 34*b*, and a transportation roller pair 35 including a transportation roller 35*a* and a follower roller 35*b*.

The delivery roller pair 33 is disposed below the damping mechanism 32 at a position behind the roll paper compartment 7. The delivery roller 33*a* is disposed horizontally widthwise to the printer between the left and right side panels 15 and 16 of the printer frame 11. Torque from a delivery motor 37 is transferred through a speed-reducing gear train 36 to the delivery roller 33*a*. The follower roller 33*b* is supported freely rotatably at the distal end part (the end part to the back of the printer) of a roller support lever 38 that is attached to the platen frame 25 on the cover unit 3 side. When the cover unit 3 is closed, the force of the damper spring 27 pushes the follower roller 33*b* against the delivery roller 33*a* with the paper 8*a* therebetween.

The paper feed roller pair 34 is disposed at a position behind the platen 26. The paper feed roller 34*a* is attached to the platen frame 25 on the cover unit 3 side, and the follower roller 34*b* is disposed on the printer frame 11 side. When the cover unit 3 is closed, torque from the paper feed motor 39 mounted on the printer frame 11 is transferred through a speed-reducing gear train 40 to the paper feed roller 34*a*. The follower roller 34*b* is pressed with a specific amount of pressure to the paper feed roller 34*a* with the paper 8*a* therebetween.

The transportation roller pair 35 is disposed at a position in front of the platen 26 (downstream on the paper transportation path). The transportation roller 35*a* is disposed to the platen frame 25 on the cover unit 3 side, and the follower roller 35*b* is disposed on the printer frame 11 side. The transportation roller 35*a* is connected to the paper feed roller 34*a* through a gear train not shown, and rotates in synchronization with the paper feed roller 34*a*. When the cover unit 3 is closed, the follower roller 35*b* is pressed to the transportation roller 35*a* with the paper 8*a* therebetween.

The paper 8*a* delivered from the roll paper 8 is conveyed through the supply position (nipping part) of the delivery roller pair 33, the damping mechanism 32, and the feed position (nipping part) of the paper feed roller pair 34 over the surface of the platen 26, and through the transportation roller pair 35 and the paper transportation path to the paper exit 4. The part of the paper 8*a* between the delivery roller pair 33 and the paper feed roller pair 34 travels around the damping mechanism 32, and is urged upward with a specific amount of tension applied thereto by the damping mechanism 32.

The inkjet head 28 prints on the surface of the paper 8*a* as the paper travels through the paper feed roller pair 34 and over the printing position at the platen 26. After the inkjet head 28 prints a line across the width of the paper 8*a*, the roller pairs 33 to 35 are driven rotationally to advance the paper 8*a* a predetermined pitch. The next line is then printed. The paper 8*a* is thus printed by the inkjet head 28 as the paper 8*a* is conveyed intermittently a predetermined pitch. A paper cutting mechanism such as a scissor-type cutting mechanism (not shown in the figure) is disposed to the paper exit 4 from which the paper 8*a* is discharged after printing. The paper cutting mechanism cuts across the width of the paper 8*a* positioned between the blades.

Control System

Figure 4:
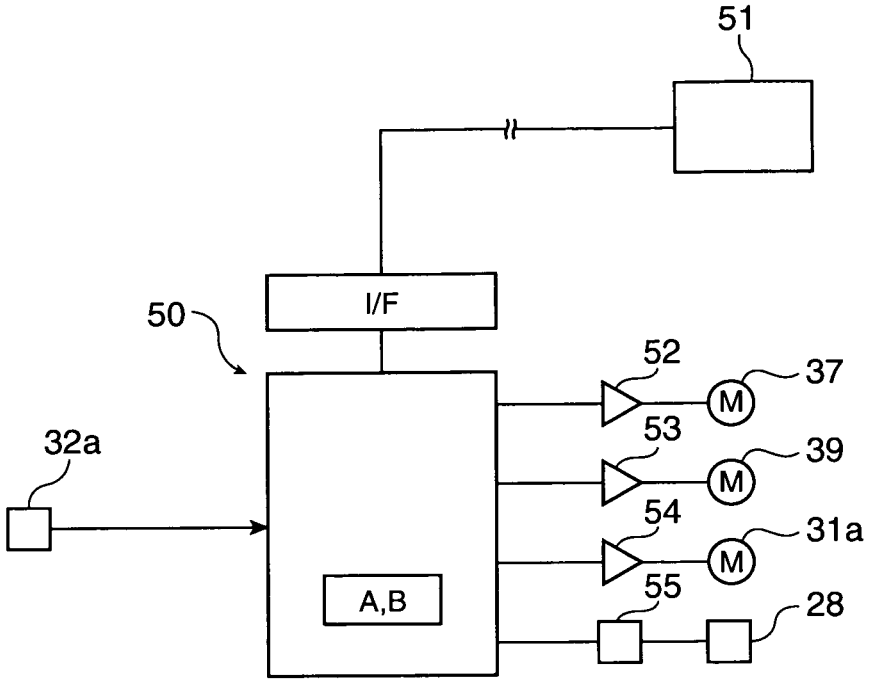
FIG. 4 is a schematic block diagram showing the control system of the printer.

FIG. 4 is a block diagram showing the control system of the roll paper printer 1. The control system is built around a drive control unit 50 that has a CPU and memory. The drive control unit 50 receives print data supplied from a host device 51 such as a host computer, and executes the paper feed operation and printing operation. Detection signals such as a detection signal indicating the carriage position from sensors not shown are input to the drive control unit 50, and based thereon the drive control unit 50 controls driving the delivery motor 37, paper feed motor 39, and carriage motor 31*a* through motor drivers 52, 53, 54 including transistors, and controls driving the inkjet head 28 through a head driver 55.

Stepping motors are used for the delivery motor 37 and paper feed motor 39. Other types of motors may obviously be used instead.

The drive control unit 50 controls driving the delivery motor 37 based on a detection signal 32S (paper 8*a* tension) from the sensor 32*a* that detects the position of the damping mechanism 32, the on/off state (paper feed operation start and stop) of the paper feed motor 39, the speed of the paper feed motor 39 (the paper feed rate of the paper feed roller 34*a*), and the drive step count (paper feed distance) of the paper feed motor 39, and controls the paper delivery operation and the paper return operation of the delivery roller 33*a*. The drive control unit 50 also controls driving the delivery motor 37 in different drive control states when the paper 8*a* is fed forward and when the paper 8*a* is reversed.

Correlation tables A and B that are used to control driving the delivery motor 37 are stored in the storage area of the drive control unit 50. As further described below, the delay times for starting and stopping the paper delivery operation of the delivery roller 33*a* are set based on these tables.

Controlling Conveying Paper Forward

Figure 6A:
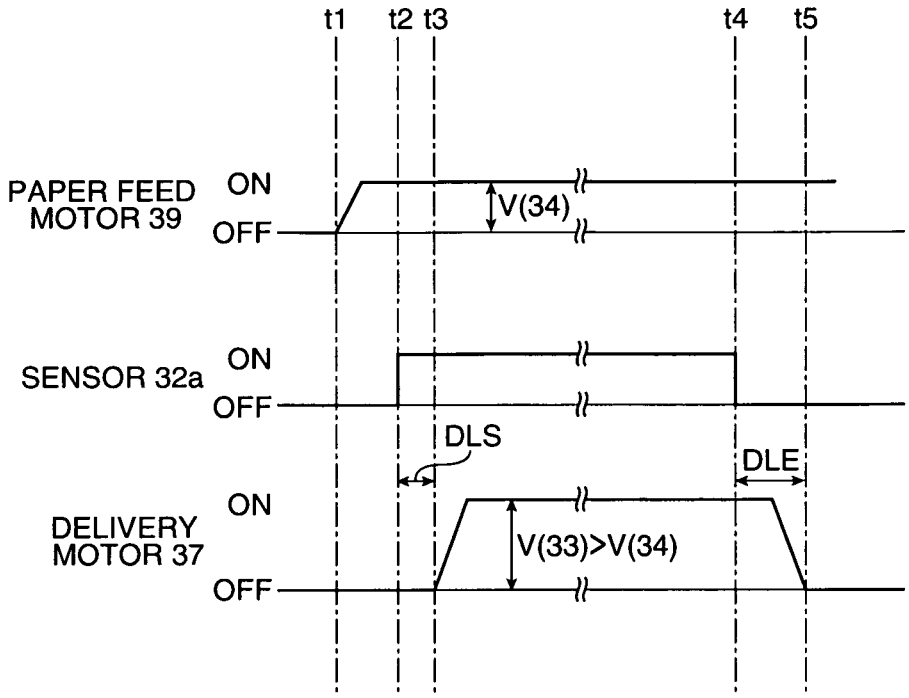
FIG. 6 is a timing chart of the delivery operation and the return operation.

FIG. 5A is a flow chart of the paper transportation control operation of the roll paper printer 1, and shows the paper delivery operation of the delivery roller pair 33 driven by the delivery motor 37 when the paper 8*a* is fed forward. FIG. 6A is a timing chart of this paper delivery operation.

The paper 8*a* is loaded with the part of the paper 8*a* web located between the delivery position of the delivery roller pair 33 and the feed position of the paper feed roller pair 34 travelling around the damping mechanism 32. When thus loaded, the damping mechanism 32 keeps a specific amount of tension applied to the paper 8*a* supplied to the paper feed roller pair 34.

For example, if the leading end of the paper 8*a* is positioned at the printing position of the inkjet head 28, print data is received from the host device 51, and the printing operation starts, the paper 8*a* is advanced until the start-of-printing position at the leading end part of the paper 8*a* is at the printing position. The paper feed motor 39 is therefore driven first, and the paper feed roller pair 34 and transportation roller pair 35 start advancing the paper 8*a* in the normal forward direction (at time t1 in FIG. 6A). Because the paper 8*a* is pulled out by the paper feed roller pair 34, the tension on the paper 8*a* increases, and the damping mechanism 32 is pushed down according to the increase in tension.

If the paper 8*a* tension increases until it exceeds a preset upper tension limit, the damping mechanism 32 descends to the detection range of the sensor 32*a*, and the detection signal 32S from the sensor 32*a* rises from an off level to an on level (time t2 in FIG. 6A). The drive control unit 50 knows that the paper tension exceeded the upper tension limit when the detection signal 32S changes to on (step ST1 in FIG. 5A).

The drive control unit 50 then counts a specific start operation delay time DLS (first delay time) from when it detects that the paper tension exceeded the upper tension limit (step ST2 in FIG. 5A), starts the delivery motor 37 when this delay time has passed, and starts the delivery operation of the paper 8*a* by the delivery roller 33*a* (step ST3 in FIG. 5A, time t3 in FIG. 6A). The delivery speed V(33) of the paper 8*a* by the delivery roller 33*a* driven rotationally by the delivery motor 37 is set to a faster speed than the feed rate V(34) of the paper 8*a* by the paper feed roller 34*a* driven rotationally by the paper feed motor 39.

Because the delivery speed of the paper 8*a* by the delivery roller pair 33 is faster, the amount of paper supplied by the delivery roller pair 33 is greater than the amount of paper fed forward by the paper feed roller pair 34, slack therefore develops in the paper 8*a* and the tension is reduced. The damping mechanism 32 is therefore pushed back up by the urging force of the spring. When the paper 8*a* tension returns to less than or equal to the upper tension limit, the damping mechanism 32 moves up and out of the detection range of the sensor 32*a*, and the detection signal 32S turns off again (step ST5 in FIG. 5A, time t4 in FIG. 6A).

The drive control unit 50 counts a specific stop operation delay time DLE (second delay time) from when the tension is detected to have returned to or below the upper tension limit (step ST6 in FIG. 5A), and when this delay time has passed stops the delivery motor 37 and stops the delivery operation of the paper 8*a* by the delivery roller pair 33 (step ST7 in FIG. 5A, time t5 in FIG. 6A). Thereafter, the delivery motor 37 is started and stopped after a specific delay time after the sensor 32*a* turns on and off, thus controlling starting and stopping the paper delivery operation of the delivery roller pair 33, assisting the paper feed operation of the paper feed roller pair 34, suppressing the increase in tension on the paper 8*a*, and thus suppressing variation in the tension.

When the paper 8*a* tension increases, the paper delivery operation of the delivery roller pair 33 thus starts and reduces the tension on the paper 8*a*. Hysteresis of a specific time is also imparted by the start operation delay time DLS and stop operation delay time DLE to the starting and stopping control of the delivery operation by the delivery roller pair 33 so that the delivery operation does not start and stop frequently. The paper tension (paper feed load) normally varies constantly during the paper 8*a* feed operation. The paper 8*a* tension therefore often momentarily exceeds the upper tension limit and soon returns below the upper tension limit. Because the paper delivery operation will repeatedly and frequently start and stop as the tension on the paper 8*a* fluctuates above and below the upper tension limit if the paper delivery operation of the delivery roller pair 33 is controlled to start and stop whenever the sensor 32*a* that detects the paper 8*a* tension goes on and off, the tension will fluctuate repeatedly above and below the upper tension limit, causing control of the delivery operation to chatter or flutter. The control method according to this embodiment of the invention enables avoiding this condition.

The average paper feed rate while printing is greatly less than the continuous feed rate because printing and paper transportation alternate during the printing operation of an roll paper printer 1. The paper feed rate of the paper feed roller is therefore generally set to a high speed during the printing process in order to increase printer throughput. Conversely, however, when the operator presses a paper feed button to manually feed the paper to a desired position, the paper feed rate of the paper feed roller is set to a slow speed so that the paper is not fed passed the desired position.

The drive control unit 50 in this embodiment of the invention therefore changes the start operation delay time DLS and stop operation delay time DLE according to the feed rate V(34) of the paper feed roller pair 34. A correlation table A for the feed rate V(34) and start operation delay time DLS, and a correlation table B for the feed rate V(34) and stop operation delay time DLE, are therefore stored in the memory of the drive control unit 50.

It will also be obvious that the start and stop operation delay times may be calculated from the feed rate V(34) using a particular function, or the detection signal 32S may be input to the drive control unit 50 through a discrete delay circuit. In any case, however, the delay time becomes shorter as the feed rate V(34) increases.

As shown in FIG. 5B, for example, the feed rate V(34) is divided into four speed ranges S1 to S4 in correlation table A, and a gradually shorter delay time T1 to T4 is assigned from the slowest speed range S1 to the fastest speed range S4. Correlation table B is configured in the same way.

Therefore, when the paper feed rate V(34) of the paper feed roller pair 34 is fast, the rate that the tension on the paper 8*a* increases is also fast (because the tension exceeds the upper tension limit in a shorter time). A commensurately short time is therefore set as the start operation delay time DLS so that the paper feed roller 34*a* assists the paper feed operation with good response.

In addition, because the paper delivery operation of the delivery roller 33*a* stops quickly when the tension on the paper 8*a* returns to or below the upper tension limit, problems such as paper jams occurring easily because the paper 8*a* tension drops greatly and creates a large amount of slack can be avoided.

After the paper delivery operation of the delivery roller pair 33 starts, the drive control unit 50 also counts how much paper 8*a* is delivered by the delivery roller pair 33 from when the paper feed operation of the paper feed roller pair 34 stops. If the delivery motor 37 is a stepping motor, the drive control unit 50 counts the number of steps the motor is driven. If the amount of paper 8*a* supplied by the delivery roller pair 33 by the time sensor 32*a* turns off after the paper feed operation stops exceeds a preset amount, the drive control unit 50 determines that a paper jam or other problem occurred and the sensor 32*a* will not turn off, and therefore unconditionally stops the delivery motor 37. An error message is also displayed using a display indicator (not shown in the figure) on the roll paper printer 1, or an error message is sent to the host device to display an appropriate error message on the monitor of the host device (steps ST4, ST8 in FIG. 5A).

When the paper is conveyed normally and the paper feed operation of the paper feed roller pair 34 located downstream from the delivery roller pair 33 ends, slack is produced in the paper 8*a* by the delivery roller pair 33, the tension drops, the damping mechanism 32 is pushed up by the urging force of a spring, the sensor 32*a* turns off, and the paper delivery operation of the delivery roller pair 33 should stop.

If the delivery operation of the delivery roller pair 33 continues after the paper feed operation of the paper feed roller pair 34 stops, the part of the paper 8*a* located between the roller pairs 33 and 34 may lead to a paper jam, and the tension acting on the part of the paper 8*a* wound around the damping mechanism 32 may not be released. If the supply operation of the paper 8*a* by the delivery roller 33*a* continues when such a paper jam has occurred, a large amount of paper 8*a* will be delivered into the area between the delivery roller pair 33 and paper feed roller pair 34, the paper 8*a* will jam therein, the paper 8*a* may become creased or torn, and correcting the paper jam will become difficult.

This embodiment of the invention immediately stops the delivery motor 37, stops the delivery operation of the delivery roller pair 33, and displays an error message when this situation occurs, and can thus quickly report paper jams and other error states to the operator.

Controlling Conveying the Paper in the Reverse Direction

Figure 6B:
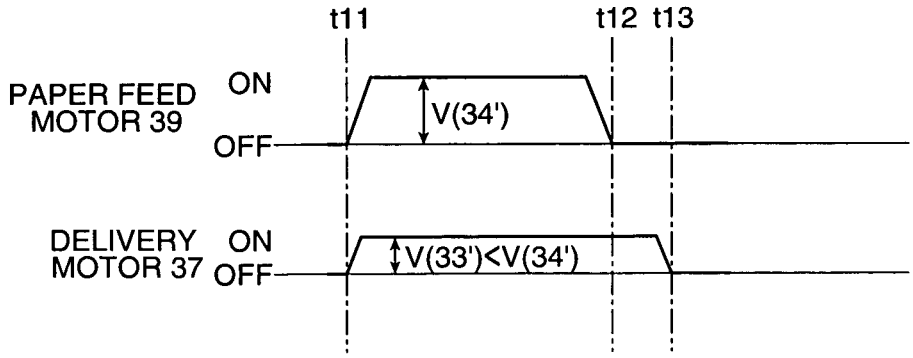

FIG. 5C is a flow chart of the paper return operation of the delivery roller 33*a* when the paper 8*a* is reversed, and FIG. 6B is a timing chart of the operation. After printing ends and the paper 8*a* is cut, for example, the paper 8*a* is reversed in the indexing operation that returns the leading end of the paper 8*a* from the cutting position to the printing position of the inkjet head 28. This is to enable printing from the leading end of the paper 8*a* after the paper 8*a* is cut in order to prevent wasting paper.

In this situation the drive control unit 50 controls the paper return operation of the delivery roller pair 33 irrespective of (without detecting) the damping mechanism 32 detection signal 32S output from the sensor 32*a*. The paper return operation of the delivery roller pair 33 is executed at this time only when the reverse feed length of the paper feed roller pair 34 is greater than or equal to a first amount. Starting the paper return operation of the delivery roller pair 33 is also linked to the start of the reverse feed operation of the paper by the paper feed roller pair 34 (step ST11 in FIG. 5C, time t11 inn FIG. 6B).

If the reverse feed length of the paper by the paper feed roller pair 34 is short, the amount of paper reversed to between the delivery roller pair 33 and paper feed roller pair 34 is minimal and there is no danger of a paper jam occurring. However, if the reverse feed length is great, a large amount of paper will be reversed to between the delivery roller pair 33 and paper feed roller pair 34 and become crumpled between the rollers. When paper becomes crumpled between the rollers, the crumpled paper can easily cause a paper jam the next time the paper is fed forward. By pulling the portion of paper that was reversed by the paper feed roller pair 34 back by the delivery roller pair 33 when the reverse feed length is greater than or equal to a first amount, the reverse feed operation of the delivery roller can be reduced.

When the paper 8*a* is reversed there is no load from the roll paper 8 on the upstream side, the load is only from the cut end of the paper 8*a*, and the paper feed load on the paper 8*a* is therefore low. The tension on the damping mechanism 32 is also low, and the sensor 32*a* will not turn on. Starting the paper return operation by the delivery roller 33*a* can therefore be linked to the start of the reverse feed operation by the paper feed roller pair 34 irrespective of the paper tension.

When reverse feeding the paper 8*a* the drive control unit 50 controls the roller speeds so that the paper return speed V(33') of the delivery roller pair 33 is slower than the reverse feed rate V(34') of the paper feed roller pair 34, that is, oppositely to when the paper 8*a* is fed forward. The reverse-fed paper 8*a* is therefore pulled by the delivery roller pair 33, and the tension on the paper 8*a* is prevented from exceeding the upper tension limit.

When the paper is reversed, the drive control unit 50 controls stopping the paper return operation of the delivery roller pair 33 according to the amount of paper 8*a* returned by the delivery roller pair 33. More specifically, the drive control unit 50 calculates the length of paper 8*a* returned by the delivery roller pair 33 based on the reverse feed length of the paper by the paper feed roller pair 34. The length of paper 8*a* returned by the delivery roller pair 33 can be set shorter than the reverse feed length of the paper feed roller pair 34. For example, the returned paper length can be set to ½ the reverse feed length. The number of drive steps required to convey the paper the calculated return length can be calculated, the delivery motor 37 is reversed based on this calculated number of steps (step ST12 in FIG. 5C), and the reversing operation is then stopped (step ST13 in FIG. 5C, time t13 in FIG. 6B).

Another Example of Controlling Conveying the Paper in the Reverse Direction

Figure 7:
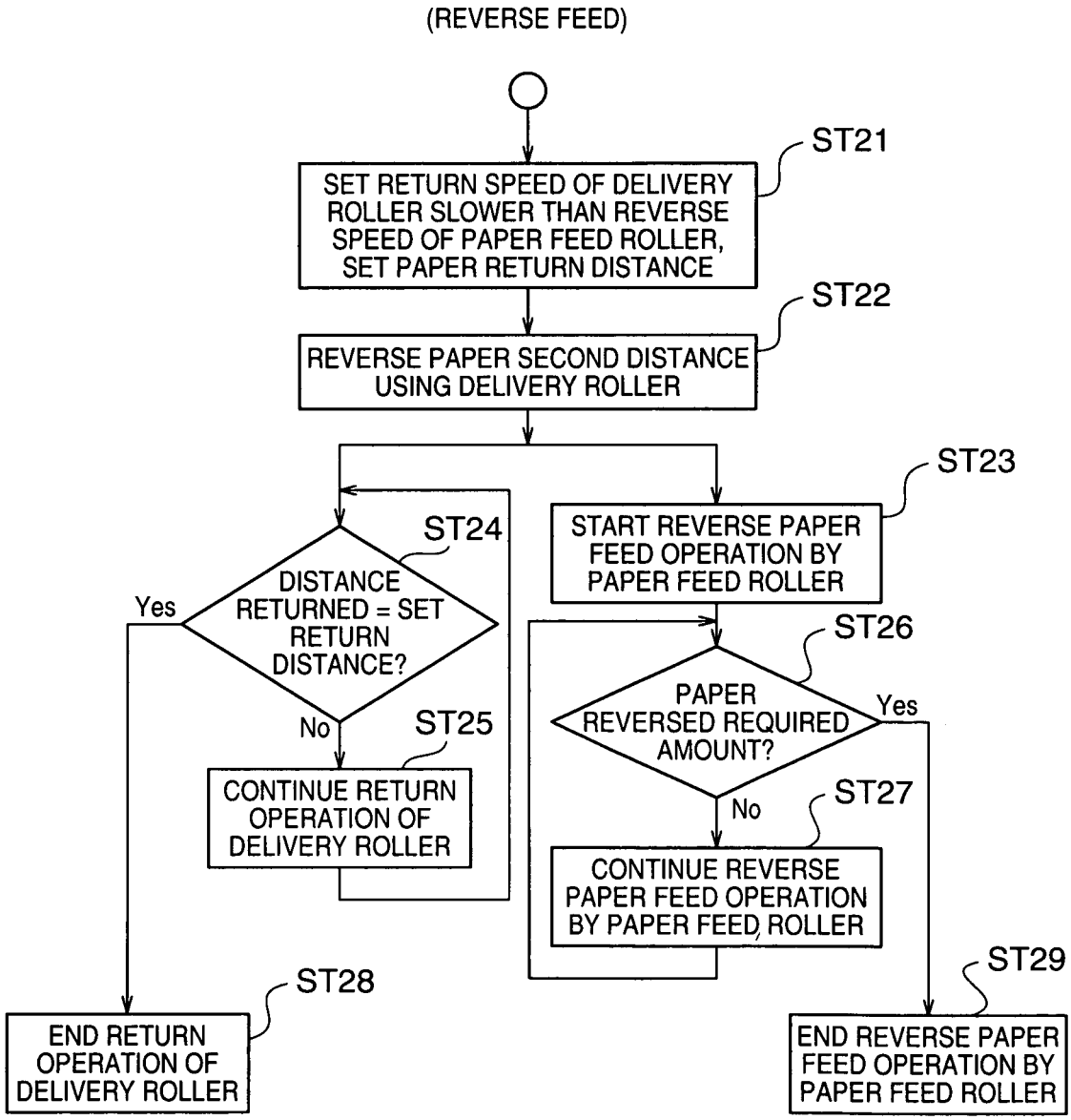
FIG. 7 is a flow chart of another example of the transportation control operation conveying the paper in the reverse direction.
Figure 8A:
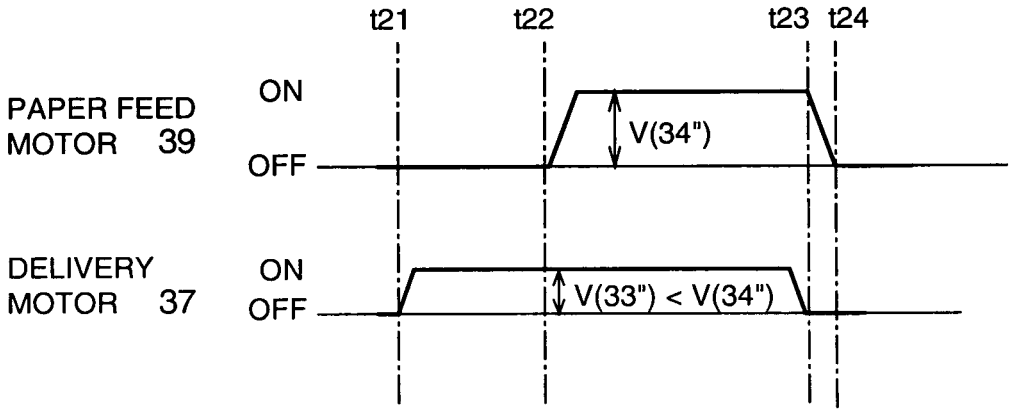
FIG. 8 is a timing chart of another example of the transportation control operation conveying the paper in the reverse direction.
Figure 8B:
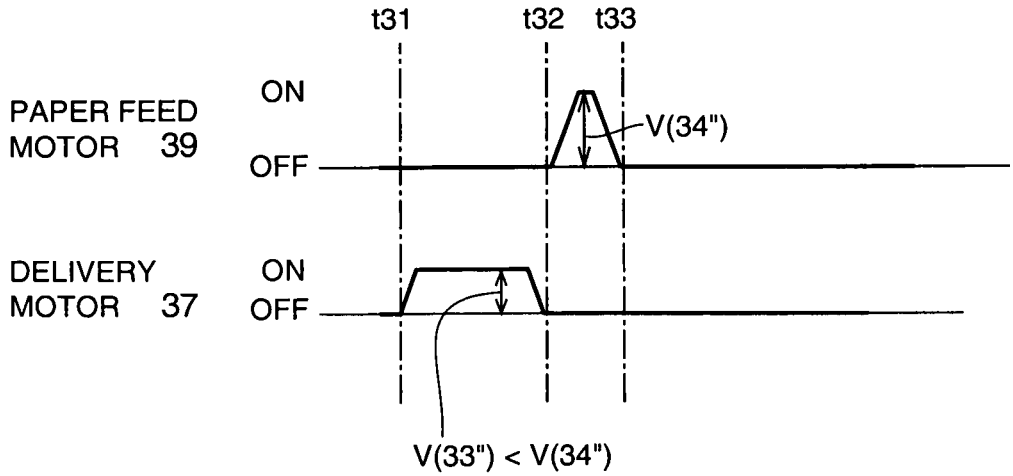
Figure 9C:
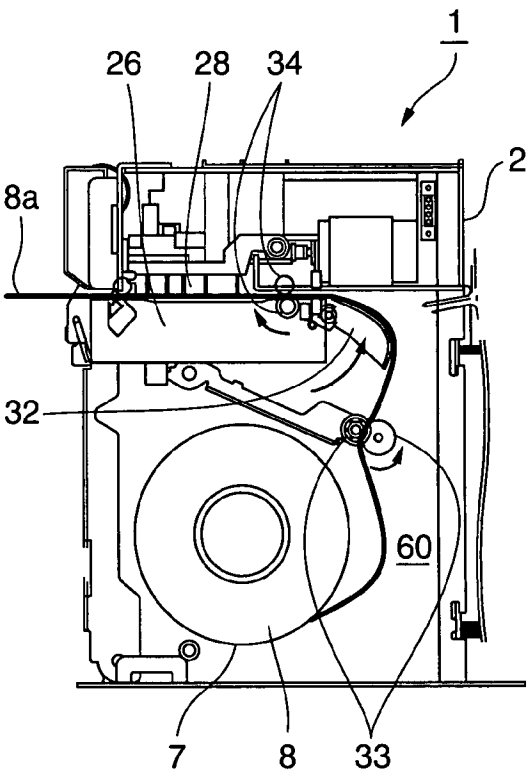
FIG. 9 shows the damping mechanism and the paper when the paper is reversed.
Figure 9B:
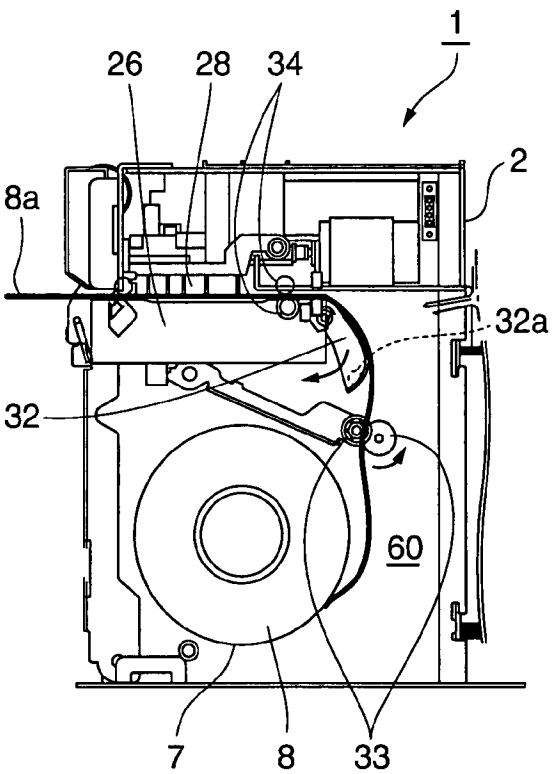
Figure 9A:
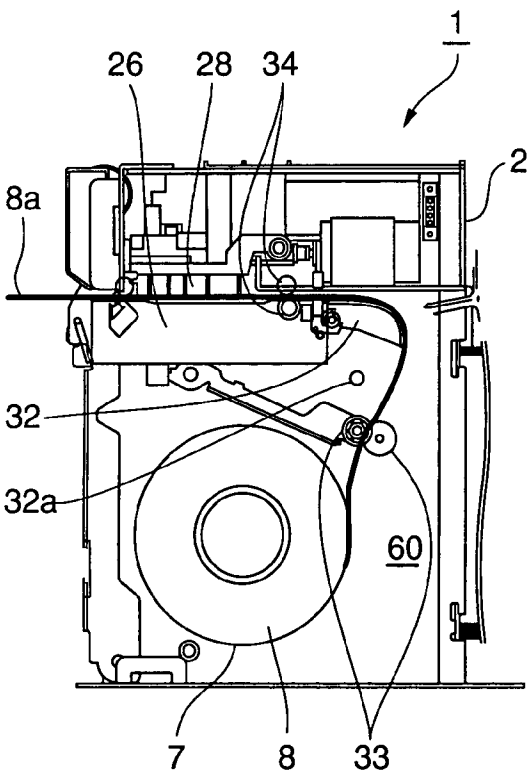

FIG. 7 is a flow chart of another operation for controlling conveying the paper 8*a* in the reverse direction. FIG. 8A and FIG. 8B are timing charts of this operation. FIG. 8A describes operation when the reverse feed length by the paper feed roller pair 34 is greater than or equal to a second amount, and FIG. 8B describes operation when the reverse feed length by the paper feed roller pair 34 is less than the second amount. FIG. 9A and FIG. 9B schematically describe the operation of the damping mechanism 32 and the condition of the paper 8*a* when the paper 8*a* is being pulled back. FIG. 9A shows the condition before conveying the paper 8*a* in reverse starts. FIG. 9B shows the condition when the paper 8*a* is only pulled back the second amount, and shows the condition when the operations of feeding the paper 8*a* in reverse and pulling the paper 8*a* back (returning the paper 8*a* toward the roll paper compartment) occur simultaneously.

Conveying the paper 8*a* in reverse is done, for example, in the indexing operation that returns the leading end of the paper 8*a* from the cutting position to the printing position of the inkjet head inkjet head 28 after printing ends and the paper 8*a* is cut. Conveying the paper 8*a* forward has ended when the paper 8*a* is cut. Therefore, as shown in FIG. 9A, the damping mechanism 32 is in an appropriate position, and the paper 8*a* is held with a suitable amount of tension that is lower than the upper tension limit applied thereto.

When the paper 8*a* is conveyed in reverse, the drive control unit 50 sets the return speed V(33") of the paper 8*a* by the delivery roller pair 33 to a slower speed than the reverse feed rate V(34") of the paper feed roller pair 34.

The drive control unit 50 controls ending the return operation of the paper 8*a* by the delivery roller pair 33 based on the length of paper 8*a* pulled back by the delivery roller pair 33. More specifically, the amount of paper returned by the delivery roller pair 33 is set based on the reverse feed length of the paper 8*a* by the paper feed roller pair 34, and the total drive step count of the delivery motor 37 required to convey the paper the set return length is calculated in advance (step ST21, before time 21 in FIG. 8A, and before time t31 in FIG. 8B).

The returned length of the paper 8*a* by the delivery roller pair 33 is set greater than or equal to a preset second amount, and greater than or equal to the reverse feed length of the paper 8*a* by the paper feed roller pair 34.

More specifically, when the reverse feed length by the paper feed roller pair 34 is less than the second amount, the returned length of paper 8*a* by the delivery roller pair 33 is set to the second amount. When the reverse feed length by the paper feed roller pair 34 is greater than or equal to the second amount, the returned length of paper 8*a* by the delivery roller pair 33 is set to substantially the same amount as the reverse feed length of the paper feed roller pair 34.

The second amount is the return amount that produces tension exceeding the upper tension limit on the paper 8*a* when the delivery roller pulls the paper 8*a* back toward the roll paper compartment. In other words, the second amount is the returned paper length at which the operation of the delivery roller pair 33 pulling the paper 8*a* back causes the damping mechanism 32 to descend from a desirable tension position into the detection range of the sensor. Because this second amount can be measured and known in advance, the specific number of steps that the delivery motor 37 must be driven to reverse the paper this second amount can also be calculated in advance.

The paper 8*a* return operation of the delivery roller pair 33 then starts, and the paper 8*a* is pulled back the second amount by the delivery roller pair 33 (step ST22).

The drive control unit 50 then causes the delivery motor 37 to drive in reverse the specific number of drive steps that was previously calculated to pull the paper 8*a* back the second amount irrespective of (without detecting) the damping mechanism 32 detection signal 32S output from the sensor 32*a*. Drive control for pulling the paper 8*a* back this second amount is thus simple.

When the paper 8*a* has been conveyed the second amount in reverse, the damping mechanism 32 descends into the detection range of the sensor 32*a* as shown in FIG. 9B. The paper 8*a* conveyed in reverse also sags slightly into the dead space 60 between the delivery roller and the roll paper compartment 7 (specifically, the point from where the paper is pulled off the roll).

When the length of the paper 8*a* pulled back by the delivery roller pair 33 reaches the second amount, the reverse feed operation of the paper 8*a* by the paper feed roller pair 34 starts (step ST23).

More specifically, when the reverse feed length of the paper feed roller pair 34 is greater than or equal to the second amount, the reverse feed operation by the paper feed roller pair 34 starts (steps ST23, ST26, ST27, time t22 in FIG. 8A) parallel to the return operation of the paper 8*a* by the delivery roller pair 33 (steps ST24, ST25).

If the reverse feed length by the paper feed roller pair 34 is less than the second amount, the paper 8*a* return operation of the delivery roller pair 33 ends because the returned length of the paper 8*a* by the delivery roller pair 33 is set to the second amount (steps ST24, ST28). The reverse feed operation of the paper 8*a* by the paper feed roller pair 34 therefore starts independently (steps ST23, ST26, ST27, time t32 in FIG. 8B).

Because the return speed V(33") of the paper 8*a* by the delivery roller pair 33 is slower than the reverse feed rate V(34") of the paper 8*a* by the paper feed roller pair 34 when the reverse feed length by the paper feed roller pair 34 is greater than or equal to the second amount and the reverse feed operation of the paper 8*a* by the paper feed roller pair 34 runs parallel to the return operation of the paper 8*a* by the delivery roller pair 33, the paper 8*a* is conveyed while reducing the tension on the paper 8*a* between the paper feed roller pair 34 and delivery roller pair 33. As a result, as shown in FIG. 9C, the damping mechanism 32, which has descended into the detection range of the sensor 32*a*, pivots upward toward the desirable tension position in conjunction with the paper 8*a* travelling in reverse. The paper 8*a* conveyed in reverse loosens even more into the dead space 60 between the delivery roller pair 33 and the roll paper compartment 7.

The delivery roller pair 33 is disposed below the damping mechanism 32, which pivots vertically at a position at the back of the platen 26. As a result, when the damping mechanism 32 pivots down in step ST21 and descends into the detection range of the sensor 32*a*, the tensioned paper 8*a* enters the feed position (nipping position) of the delivery roller pair 33 at an angle to a tangent to the delivery roller 33*a* (FIG. 9B). If the delivery roller pair 33 pulls the paper 8*a* back from this position, the paper 8*a* that has already passed the feed position will wind around the surface of the delivery roller pair 33, retract in the direction of rotation, and sag. As a result, because the direction in which the paper 8*a* sags is the same as the direction of the curl of the paper wound on the roll, the repulsion of the paper 8*a* to the sag alleviates or prevents the position of the paper 8*a* from shifting sideways. If the paper 8*a* is label paper, the labels are also prevented from peeling off the web liner.

When the drive step count of the delivery motor 37 that drives the delivery roller pair 33 reaches the total drive step count, the return operation of the paper 8*a* by the delivery roller pair 33 ends (steps ST24, ST28, time t23 in FIG. 8A). When the paper 8*a* is conveyed the required reverse feed length by the paper feed roller pair 34, the drive control unit 50 ends the reverse feed operation of the paper 8*a* by the paper feed roller pair 34 (steps ST26, ST29, time t24 in FIG. 8A).

If the reverse feed operation of the paper 8*a* by the paper feed roller pair 34 occurs when the reverse feed length of the paper feed roller pair 34 is less than the second amount and the paper 8*a* return operation of the delivery roller pair 33 ends at step ST21, the paper 8*a* is conveyed while the tension on the paper 8*a* decreases. The damping mechanism 32, which had descended into the detection range of the sensor 32*a*, therefore pivots up toward the desirable tension position in conjunction with the paper 8*a* travelling in reverse.

When the paper 8*a* has been conveyed the required distance in reverse by the paper feed roller pair 34, the drive control unit 50 ends the reverse feed operation of the paper 8*a* by the paper feed roller pair 34 (steps ST26, ST29, and time t33 in FIG. 8B).

Because the amount the paper 8*a* is pulled back by the delivery roller pair 33 is set greater than or equal to the reverse feed length of the paper 8*a* by the paper feed roller pair 34, the paper 8*a* is held in tension between the paper feed roller pair 34 and delivery roller pair 33 while the paper 8*a* is conveyed in reverse. The paper 8*a* is thus prevented from becoming skewed between the paper feed position and the supply (delivery) position, the distance the paper 8*a* is conveyed in reverse by the paper feed roller pair 34 is stable, and the position of the paper 8*a* does not shift widthwise. A drop in print quality when the paper 8*a* is then fed forward for printing can thus be avoided.

Because the paper 8*a* goes slack on the upstream side of the delivery roller pair 33 when the paper 8*a* is reversed as described above, problems can result from the sudden load on the paper feed roller pair 34 when the slack is taken up when the paper 8*a* is next advanced for printing. However, because the tension on the paper 8*a* is reduced from the maximum tension while the paper 8*a* is reversed and is reset to a desirable level when reversing the paper 8*a* ends, any sudden increase in the paper feed load that may occur is within the range that can be buffered by the damping mechanism 32.

Furthermore, because the returned length of the paper 8*a* by the delivery roller pair 33 is substantially equal to the reverse feed length of the paper 8*a* by the paper feed roller pair 34 when the reverse feed length of the paper 8*a* by the paper feed roller pair 34 is greater than or equal to the second amount, the tension on the paper 8*a* when the operation conveying the paper 8*a* in reverse stops is the same as the tension when the operation conveying the paper 8*a* in reverse starts. More specifically, because the paper 8*a* returns to an appropriately tensioned state when the operation reversing the paper 8*a* ends, it is simple to keep the paper 8*a* appropriately tensioned when the paper 8*a* is next fed forward for printing, and a drop in print quality can be avoided.

In addition, because the return speed V(33") of the paper 8*a* by the delivery roller pair 33 is slower than the reverse feed rate V(34") of the paper 8*a* by the paper feed roller pair 34, the problem of the paper 8*a* being pulled by the delivery roller pair 33 and the tension on the paper 8*a* exceeding the upper tension limit can be prevented. Furthermore, because a low speed motor can be used for the delivery motor 37, product cost can be kept low.

Furthermore, because the second amount is the returned length that causes the paper 8*a* tension to rise to the upper tension limit during the return operation of the delivery roller pair 33, the problem of the tension on the paper 8*a* exceeding the upper tension limit can be prevented. In addition, because a long second amount can be assured, conveying the paper 8*a* in a desirably tensioned state can be easily controlled even when the reverse feed length of the paper 8*a* by the delivery roller pair 33 increases.

In addition, because the slack in the reverse-fed paper 8*a* that occurs between the delivery roller pair 33 and roll paper compartment 7 when the paper 8*a* is conveyed in reverse is received into dead space 60 inside the printer case 2, it is not necessary to provide a separate space for receiving slack in the paper 8*a* and this embodiment of the invention does not interfere with reducing device size.

Note that if there is no dead space 60 inside the printer case 2 for receiving the paper 8*a* slack, a space for receiving the paper 8*a* slack can be simply rendered between the delivery roller pair 33 and roll paper compartment 7. Slack in the paper 8*a* reduces the load when forward feed starts.

Another Example of Controlling Conveying the Paper in the Reverse Direction

Figure 10:
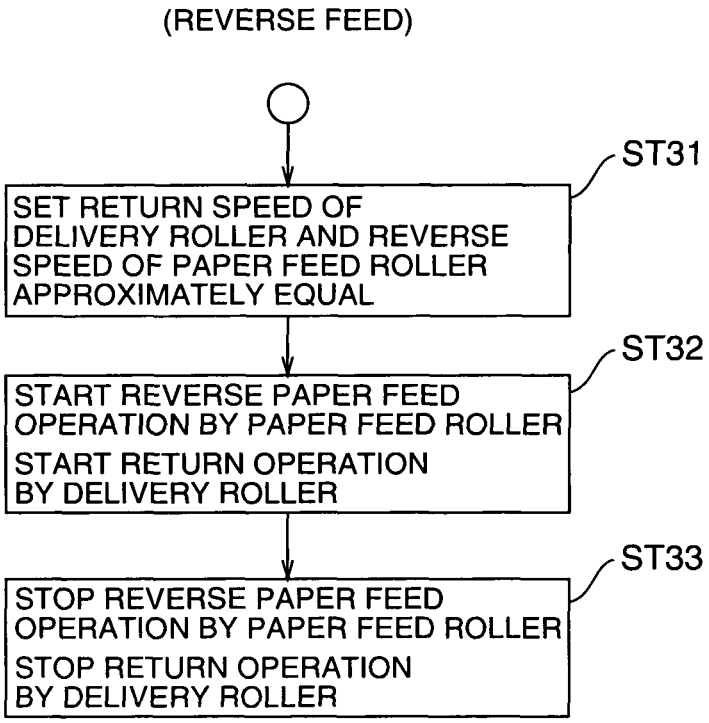
FIG. 10 is a flow chart of another example of the transportation control operation conveying the paper in the reverse direction.
Figure 11:
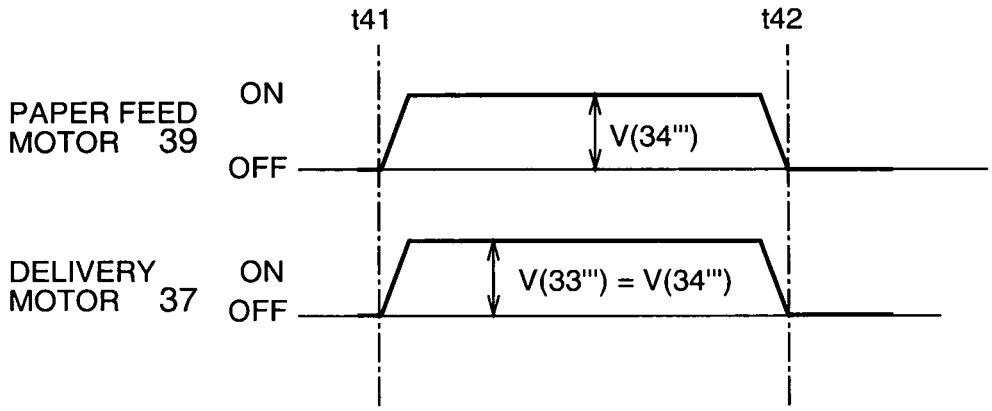
FIG. 11 is a timing chart of another example of the transportation control operation conveying the paper in the reverse direction.

FIG. 10 is a flow chart of an operation controlling conveying the paper 8*a* in the reverse direction. FIG. 11 is a timing chart of this operation.

When the paper 8*a* is conveyed in reverse, the drive control unit 50 sets the return speed V(33''') of the paper 8*a* by the delivery roller pair 33 and the reverse feed rate V(34''') of the paper feed roller pair 34 to substantially the same speed (step ST31).

The reverse feed operation of the paper 8*a* by the paper feed roller pair 34 and the return operation of the paper 8*a* by the delivery roller pair 33 are then executed synchronously. More specifically, the reverse feed operation and the return operation are started simultaneously (step ST32, time t41 in FIG. 11) and stopped simultaneously (step ST33, time t42 in FIG. 11).

Because the reverse feed operation of the paper 8*a* by the paper feed roller pair 34 and the return operation of the paper 8*a* by the delivery roller pair 33 are then executed synchronously in this embodiment of the invention, the paper 8*a* is conveyed in reverse with the suitable tension when forward transportation ended on the paper 8*a* between the paper feed roller pair 34 and delivery roller pair 33. As a result, because the paper 8*a* can be prevented from becoming skewed between the paper feed position and the delivery position while the paper 8*a* is conveyed in reverse, the distance that the paper 8*a* is reversed by the paper feed roller pair 34 is stable and the position of the paper 8*a* does not shift widthwise to the paper. A drop in print quality can therefore be avoided when the paper 8*a* is next conveyed forward for printing.

The tension on the paper 8*a* also does not change between when the operation conveying the paper in reverse starts and when the operation conveying the paper 8*a* in reverse ends. It is therefore simple to keep the paper 8*a* appropriately tensioned when the paper 8*a* is next fed forward for printing, and a drop in print quality can be avoided.

Furthermore, because the tension on the paper 8*a* will not exceed a preset upper tension limit the next time the forward feed operation starts, operation of the paper feed roller 34*a* can start reliably and fast printing can be achieved without needing to start the delivery operation of the paper 8*a* by the delivery roller 33*a* after delaying operation by a specific start operation delay time.

When the paper 8*a* is reversed by synchronizing the reverse feed operation of the paper 8*a* by the paper feed roller 34*a* and the return operation of the paper 8*a* by the delivery roller 33*a*, the paper 8*a* goes slack on the upstream side of the paper delivery position, and when the slack disappears when the paper 8*a* is next fed forward for printing, problems can be caused by the sudden load on the paper feed roller 34*a*. However, because the tension on the paper 8*a* when the paper 8*a* is reversed is held to a suitable level, any sudden increase in the paper feed load that may occur is within the range that can be buffered by the damping mechanism 32.

Other Aspects of at Least One Embodiment of the Invention

At least one embodiment of the invention is described above using a serial roll paper printer by way of example, but at least one embodiment of the invention can obviously also be used with a line-type roll paper printer. At least one embodiment of the invention has also been described using an inkjet printer by way of example, but at least one embodiment of the invention can obviously also be used with roll paper printers having other types of print heads, including thermal heads. Furthermore, the same control method used when feeding the paper forward can be used if the paper feed load is high when reversing the paper.

At least one embodiment of the invention being thus described, it will be obvious that it may be varied in many ways. Such variations are not to be regarded as a departure from the spirit and scope of at least one embodiment of the invention, and all such modifications as would be obvious to one skilled in the art are intended to be included within the scope of the following claims.

What is claimed is:

1. A paper transportation control method for an apparatus having a delivery roller that delivers paper and a paper feed roller that feeds the paper delivered, and a damping mechanism located between the delivery roller and the paper feed roller and for adjusting a tension on the paper, the paper transportation control method comprising steps of:

detecting if the tension on the paper exceeds a predefined upper tension limit; and starting a paper delivery operation of the delivery roller when the paper is conveyed forward after elapse of a first delay time from when the tension is detected to exceed the upper tension limit.

2. The paper transportation control method for an apparatus described in claim 1, further comprising a step of:

stopping the paper delivery operation of the delivery roller when the paper is conveyed forward after elapse of a second delay time from when the tension is detected to become less than or equal to the upper tension limit.

3. The paper transportation control method for an apparatus described in claim 1, wherein:

the time of at least one of the first delay time and the second delay time becomes shorter as a paper feed rate of the paper feed roller becomes faster.

4. The paper transportation control method for an apparatus described in any of claims 1 to 3, wherein:

a delivery speed of paper by the delivery roller is faster than the paper feed rate of the paper feed roller when the paper is conveyed forward.

5. The paper transportation control method for an apparatus described in claim 1, further comprising steps of:

counting a length of paper delivered by the delivery roller from when the paper feed operation of the paper feed roller stops when the paper is conveyed forward; and stopping the delivery roller when the delivered length of paper exceeds a predefined amount.

6. The paper transportation control method for an apparatus described in claim 1, wherein:

a paper return operation is executed by the delivery roller only when a reverse feed length of the paper by the paper feed roller is greater than or equal to a first amount when conveying the paper in reverse.

7. The paper transportation control method for an apparatus described in claim 6, wherein:

starting the paper return operation of the delivery roller is linked to starting a reverse feed operation of paper by the paper feed roller that conveys the paper in reverse.

8. The paper transportation control method for an apparatus described in claim 6, wherein:

when conveying the paper in reverse, a return speed of paper by the delivery roller is slower than a reverse feed rate of paper by the paper feed roller.

9. The paper transportation control method for an apparatus described in claim 6, wherein:

a return length of paper by the delivery roller is set to less than the reverse feed length of paper by the paper feed roller; and the delivery roller is stopped when the delivery roller pulls the paper back the return length.

10. The paper transportation control method for an apparatus described in claim 1, wherein:

when conveying the paper in reverse, a return speed of paper by the delivery roller and a reverse feed rate of paper by the paper feed roller are set substantially the same, and a reverse feed operation of paper by the paper feed roller and a return operation of paper by the delivery roller are executed substantially synchronously.

11. The paper transportation control method for an apparatus described in claim 10, wherein:

paper slack is formed between a pull-off position where the paper is pulled off the paper roll and the delivery roller.

12. An apparatus comprising:

a roll paper storage unit that stores roll paper;

a delivery roller that delivers paper from the roll paper;

a paper feed roller that feeds the delivered paper;

a damping mechanism that adjusts a tension on the paper and is located between the delivery roller and the paper feed roller;

a sensor that detects the tension on the paper;

a paper feed motor that rotationally drives the paper feed roller;

a delivery motor that rotationally drives the delivery roller; and a control unit that controls the paper feed motor and the delivery motor based on detection by the sensor, controls conveying the paper forward or reverse, and executes the paper transportation control method described in claim 11, wherein a space is formed between the roll paper storage unit and the delivery roller.

13. The paper transportation control method for an apparatus described in claim 1, further comprising steps of:

setting a return length of paper by the delivery roller greater than or equal to a predefined second amount and greater than or equal to a reverse feed length of the paper by the paper feed roller, and setting a return speed of paper by the delivery roller slower than a reverse feed rate of the paper by the paper feed roller when conveying the paper in reverse;

starting a paper return operation of the delivery roller;

starting a reverse feed operation of paper by the paper feed roller when the return length of paper by the delivery roller reaches the second amount; and stopping the delivery roller when the delivery roller has pulled the paper back the return length.

14. The paper transportation control method for an apparatus described in claim 13, wherein:

the second amount is equal to the return length that produces tension equal to the upper tension limit on the paper as a result of the paper return operation of the delivery roller.

15. The paper transportation control method for an apparatus described in claim 13, wherein:

when the reverse feed length of the paper by the paper feed roller is greater than or equal to the second amount, the return length of paper by the delivery roller is set substantially equal to the reverse feed length of the paper by the paper feed roller.

16. An apparatus comprising:

a roll paper storage unit that stores roll paper;

a delivery roller that delivers paper from the roll paper;

a paper feed roller that feeds the delivered paper;

a damping mechanism that adjusts a tension on the paper and is located between the delivery roller and the paper feed roller;

a sensor that detects the tension on the paper;

a paper feed motor that rotationally drives the paper feed roller;

a delivery motor that rotationally drives the delivery roller; and a control unit that controls the paper feed motor and the delivery motor based on detection by the sensor, controls conveying the paper forward or reverse, and executes the paper transportation control method described in claim 1.

* * * * *